United States Patent [19]

Ishizuka et al.

[11] Patent Number: 4,805,418

[45] Date of Patent: Feb. 21, 1989

[54] INDOOR UNIT FOR ROOM AIR CONDITIONERS

[75] Inventors: Yutaka Ishizuka; Teruyuki Nagao, both of Konan, Japan

[73] Assignee: Diesel Kiki Co., Ltd., Tokyo, Japan

[21] Appl. No.: 125,983

[22] Filed: Nov. 27, 1987

[51] Int. Cl.[4] ..... F25D 19/00

[52] U.S. Cl. ..... 62/298; 165/122

[58] Field of Search ..... 165/122, 54; 62/259.1, 62/262, 298

[56] References Cited

U.S. PATENT DOCUMENTS 3,174,541 3/1965 Brandt et al. ..... 165/122

3,516,483 6/1970 Benteler et al. ..... 165/122

*Primary Examiner*—Henry A. Bennet

*Attorney, Agent, or Firm*—Wenderoth, Lind & Ponack

[57] ABSTRACT

An indoor unit for room air conditioners includes a case having two compartments which are separated by a heat exchanger and are connected respectively to an air inlet and an air outlet. A side wall of the case in which the air outlet is formed and a side wall of the case in which the air outlet is formed can be changed without using a separate component. With this construction, the indoor unit can be installed in various houses or buildings of different types and hence is suitable for mass-production.

2 Claims, 1 Drawing Sheet

INDOOR UNIT FOR ROOM AIR CONDITIONERS

BACKGROUND OF THE INVENTION

1. Field of the Invention

The present invention relates to an indoor unit for room air conditioners adapted to be disposed on the ceiling of a house or building.

2. Prior Art

An indoor unit for room air conditioners of this type is disclosed, for example, in Japanese Patent Publication No. 51-13947. The disclosed indoor unit includes a case or housing having an outside air passage leading to an exterior duct, air inlet and outlet facing respectively to predetermined directions, a blower unit disposed in the case, and a heat exchanger disposed in the case downstream of the blower unit. With this construction, air drawn from the air inlet into the case is cooled or heated by the heat exchanger and then is blow-off from the air outlet.

The known indoor unit has a drawback that due to the air inlet and outlet facing to the predetermined directions, the indoor unit is not suited with the installation to houses or buildings having different structures. With this limited application, the versatility of the indoor unit is low and hence a mass-production of the structural components is difficult to achieve.

SUMMARY OF THE INVENTION

It is accordingly an object of the present invention to provide an indoor unit for room air conditioners which has air inlet and outlet variable in position to change the directions of air intake and discharge and hence can be installed in various houses or buildings of different types.

Another object of the present invention is to provide an indoor unit incorporating structural features which enable installation of the indoor unit to different locations using common structural components, thereby enabling mass-production of the indoor unit.

According to the present invention, the foregoing and other objects are attained by an indoor unit for room air conditioners, comprising: a substantially rectangular hollow case having an air inlet and an air outlet; a heat exchanger disposed in the case and having one of its opposite ends connected to a first side wall of the rectangular case substantially at a midpoint of the first wall, the other end of the heat exchanger being connected to a second side wall adjoining the first side wall at a portion adjacent to one end of the second side wall remote from the first side wall, the heat exchanger separating the interior of the case into an intake compartment connected with the air inlet and a discharge compartment connected with the air outlet; and a blower unit disposed in the discharge compartment.

With this construction, the air inlet can be provided in any one of the side walls which define the intake compartment. Likewise, the air outlet can be provided in any one of the side walls which define the discharge compartment. Consequently, the direction of air intake and the direction of air discharge are changed to meet with requirements or conditions of a installation site of the indoor unit, without using a separate structural component.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
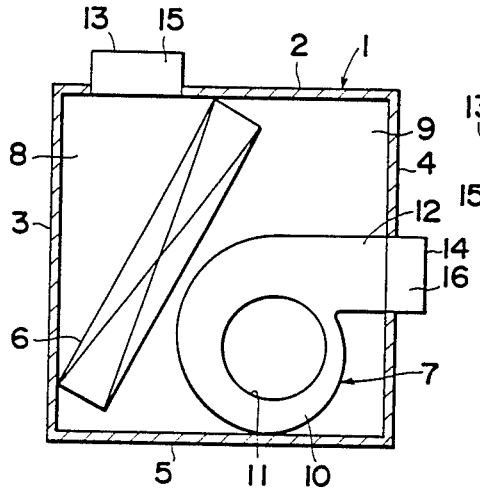
FIG. 1 is a schematic vertical cross-sectional view of an indoor unit embodying the present invention.

Certain preferred embodiments of the present invention are described below in greater detail with reference to the accompanying drawings. In the drawings, like or corresponding parts are indicated by like or corresponding reference numerals throughout several views.

As shown in FIG. 1, an indoor unit of the present invention includes a substantially rectangular hollow case 1 having a top wall 2, a pair of left and right side walls 3, 4 extending from opposite edges of the top wall 2 in a common direction, and a bottom wall 5 interconnecting lower end edges of the side walls 3, 4 and facing the top wall 2. The indoor unit also includes a heat exchanger 6 and a blower unit 7 both disposed in the case 1.

The heat exchanger 6 has a rectangular shape and is composed of a plurality of tubular elements and a plurality of fins (neither shown) joined one on another into a composite laminate form. The heat exchanger 6 is connected at its one end to the top wall 2 substantially at a midpoint of the latter, and at its opposite end to the left side wall 3 adjacent to the lower end thereof. With this inclined arrangement of the heat exchanger 6, the interior of the case 1 is separated into two parts. Namely, disposed on an upstream side of the heat exchanger 6 is an intake compartment 8 which is defined by and between a left half of the top wall 2, substantially the entire region of the left side wall 3, part of a front wall (now shown) and part of a rear wall (not designated). On the other hand, there is a discharge compartment 9 disposed downstream of the heat exchanger 6 and defined jointly by and between the right half of the top wall 2, the entire region of the right side wall 4, the entire region of the bottom wall 5 and parts of the front and rear walls.

The blower unit 7 is disposed in the discharge compartment 9 and includes a motor-driven, multi-winged fan (not shown) rotatably mounted in a casing 10. The casing 10 is scroll-shaped and has an air intake hole 11 formed in a side wall thereof and a discharge opening 12 defined at a position in which the scroll-shaped casing 10 has a maximum outside diameter. The discharge opening 12 is connected with an air outlet 14 (described later on). When a non-illustrated motor is energized, the air is drawn through an air inlet 13 into the intake compartment 8, then is cooled or heated by the heat exchanger 6 as it flows from the intake compartment 8 to the discharge compartment 9, and finally is discharged from the air outlet 14 into the room interior.

The air inlet 13 and the air outlet 14 are connected, respectively, to an air inlet tube or duct 15 and an air outlet tube 16 or duct 16. The air inlet 13 is formed in the top wall 2 and facing the intake compartment 8 while the air outlet 14 is formed in the right side wall 4 substantialy at a central portion thereof and facing the discharge compartment 9. The air outlet 14 is directly connected with the discharge opening 12 of the blower unit 7.

Figure 2:
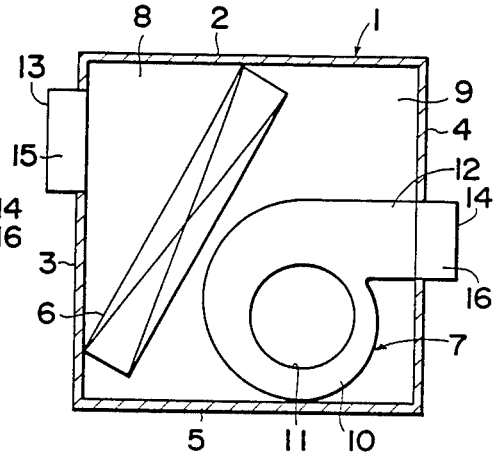
FIG. 2 is a view similar to FIG. 1, but showing a modified indoor unit.

A modified indoor unit shown in FIG. 2 is similar to the first embodiment but differs therefrom in that an air inlet 13 is defined in the left side wall 3 of the case 1. Likewise the first embodiment, the air outlet 14 is formed in the right side wall 4 and connected directly with the discharge opening 12 of the blower unit 7.

Figure 3:
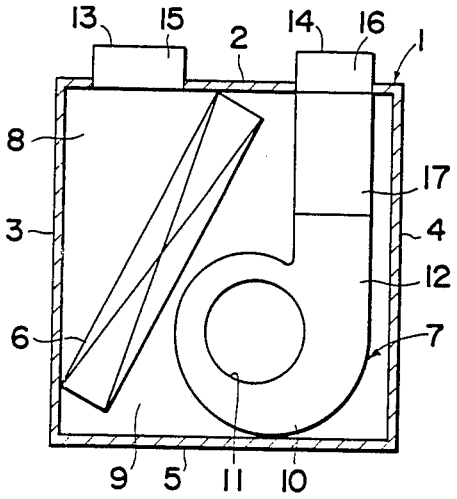
FIG. 3 is a view similar to FIG. 1, but showing another modification of the invention.

FIG. 3 shows another modified form of indoor unit which is substantially the same as the first embodiment shown in FIG. 1 except that an air outlet 14 is formed in the top wall 2 of the case 1 in tandem relation to the air inlet 13 and is connected with the discharge opening 12 of the blower unit 7 via an intermediate duct 17. The blower unit 7 of this embodiment is disposed in the discharge component 9 in an overturned or reversed orientation with respect to the posture shown in FIG. 1.

Figure 4:
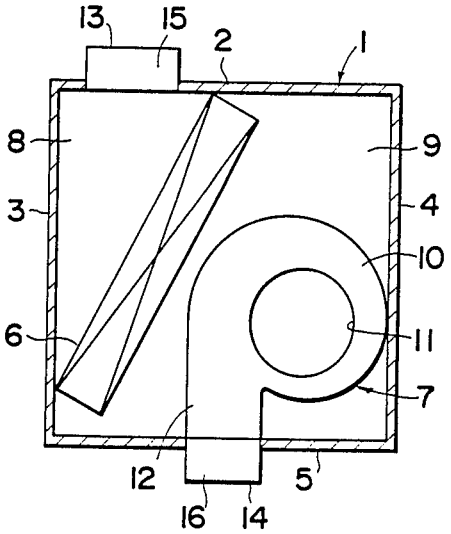
FIG. 4 is a view similar to FIG. 1, but showing another modified form of indoor unit.

A still further modified indoor unit shown in FIG. 4 differs from the embodiment of FIG. 3 in that an air outlet 14 is formed in the bottom wall 5 of the case 1 and is directly connected with the discharge opening 12 of the blower unit 7. The blower unit 7 has a posture which is inverted from the position shown in FIG. 3.

It appears from the foregoing description that the air inlet 13 may be provided in either of the top wall 2 and the left side wall 3, and the air outlet 14 also may be provided in any of the top wall 2, the right side wall 4 and the bottom wall 5. With this flexibility in positioning of the air inlet and outlet 13, 14, the direction of air intake and the direction of air discharge can be changed so as to meet with conditions or requirements of an individual installation site of the indoor unit.

Obviously, many modifications and variations of the present invention are possible in the light of the above teaching. It is therefore to be understood that within the scope of the appended claims, the invention may be practiced otherwise than as specifically described.

What is claimed is:

1. An indoor unit for room air conditioners, comprising;

(a) a substantially rectangular hollow case having first and second adjacent substantially perpendicular side walls;

(b) an air inlet and an air outlet in said substantially rectangular hollow case for fluidly connecting the interior and the exterior of said hollow case, and each said air inlet and air outlet being in said first side wall of said hollow case;

(c) a heat exchanger having first and second ends disposed in said case, said first end of said heat exchanger being connected to said first side wall of said rectangular case substantially at a midpoint of said first side wall, said second end of said heat exchanger being connected to said second side wall adjoining said first side wall at a portion adjacent to one end of said second side wall remote from said first side wall, and said heat exchanger separating the interior of said case into an intake compartment fluidly connected with said air inlet and a discharge compartment fluidly connected with said air outlet;

(d) a scroll-shaped blower unit disposed in said discharge compartment, said scroll-shaped blower unit having a discharge opening located at a position in which said scroll-shaped blower unit has a maximum outside diameter; and (e) connecting means attached to said discharge opening of said blower unit and to said air outlet in said first side wall of said substantially rectangular hollow case for fluidly communicating said discharge opening and said air outlet.

2. A device as in claim 1, wherein said connecting means is an intermediate duct.

* * * * *